US005738497A

United States Patent [19]

Hensley

[11] Patent Number: 5,738,497

[45] Date of Patent: Apr. 14, 1998

[54] APPARATUS AND METHOD FOR CONTROLLING A ROTARY SCREW COMPRESSOR

[76] Inventor: Paul D. Hensley, 3005 N. 15th St., Broken Arrow, Okla. 74012

[21] Appl. No.: 595,635

[22] Filed: Feb. 2, 1996

[51] Int. Cl.[6] ..... F01C 1/16; F04B 49/00

[52] U.S. Cl. ..... 417/53; 418/201.2; 417/310; 137/625.22

[58] Field of Search ..... 418/201.2; 417/310, 417/295, 375, 46, 53; 137/625.22

[56] References Cited

U.S. PATENT DOCUMENTS

| | | | |
|---|---|---|---|
| 3,088,658 | 5/1963 | Wagenius | 415/201.2 |
| 3,656,876 | 4/1972 | Kocher | 418/201.2 |
| 4,042,310 | 8/1977 | Schibbye | 417/310 |
| 5,044,894 | 9/1991 | Field et al. | 418/201.2 |
| 5,123,822 | 6/1992 | Yoshimura | 418/201.2 |
| 5,135,374 | 8/1992 | Yoshimura | 418/201.2 |

*Primary Examiner*—Charles G. Freay
*Assistant Examiner*—Peter G. Korytnyk
*Attorney, Agent, or Firm*—Jeffrey D. Myers; Deborah A. Peacock

[57] ABSTRACT

A process and apparatus for controlling a rotary screw compressor capacity mechanism by manual pneumatic means. The apparatus compromises a specially placed rotary type cartridge valve enclosed in a valve body and housing. The assembly is attached via a flexible coupling to a rotating indicator rod that follows internal movement of the compressor's capacity piston mechanism. Manual movement of the assembly body opens valve ports that pneumatically position the compressor's internal capacity piston.

15 Claims, 7 Drawing Sheets

APPARATUS AND METHOD FOR CONTROLLING A ROTARY SCREW COMPRESSOR

BACKGROUND OF THE INVENTION

1. Field of the Invention (Technical Field)

The invention relates to apparatuses for controlling rotary screw compressors and methods for their use.

2. Background Art

Prior art rotary screw compressors are typically controlled by application of pressure to a piston area of an internal capacity slide mechanism. The relative positions of this piston and the attached slide determine the output capacity of the compressor, from 10% to 100%, respectively. A rotating indicator rod rotates a rotary potentiometer, the variable resistance of which is, in turn electrically connected to a microprocessor. If system conditions, for example, dictate more compressor capacity, the microprocessor signals a directional solenoid valve to apply or relieve pressure to the piston area of the internal capacity slide mechanism, thereby controlling the compressor.

Manually actuated capacity slide mechanisms have also been utilized in the prior art; such mechanisms normally employ a handwheel to position the slide mechanism.

SUMMARY OF THE INVENTION (Disclosure of the Invention)

The present invention is of an apparatus for controlling a rotary screw compressor comprising: a stationary housing; a valve body rotatable within the stationary housing; and a rotary valve rotatable with the valve body; wherein selective rotation of the valve body and the rotary valve controls capacity of a rotary screw compressor. In the preferred embodiment, the stationary housing comprises a plurality of ports, preferably selectively connectable to a plurality of capacity slide mechanism ports. The valve body is preferably rotatable through an encompassing control arc comprising 282°, rotation of the valve body effects control of the rotary screw compressor between limits of 10% capacity to 100% capacity of the compressor, rotation of the rotary valve is independent of rotation of the valve body, the rotary valve is coupled to and rotated by a capacity control slide, and rotation of the rotary valve is automatically terminated in a neutral position. Selective manual rotation of the valve body and the rotary valve pneumatically controls capacity of a rotary screw compressor. The valve body preferably comprises indicia indicating compressor capacity and returns to a limit of 25% compressor capacity when the compressor stops when operating above a predetermined capacity.

The invention is also of a method of controlling a rotary screw compressor comprising: rotating a valve body within a stationary housing; and rotating a rotary valve with the valve body; wherein selective rotation of the valve body and the rotary valve pneumatically controls capacity of the rotary screw compressor. In the preferred embodiment, the stationary housing is provided with a plurality of ports connected to a plurality of capacity slide mechanism ports. The valve body is rotated through an encompassing control arc of 282°, rotating the valve body comprises effecting control of the rotary screw compressor between limits of 10% capacity to 100% capacity of the compressor, rotating the rotary valve occurs independently of rotating the valve body, coupling and rotating the rotary valve occurs by a capacity control slide mechanism, and rotation of the rotary valve at a neutral position occurs automatically. The method preferably comprises manually and pneumatically controlling capacity of a rotary screw compressor, providing to the valve body indicia indicating compressor capacity, and returning the valve body to a limit of 25% compressor capacity when the compressor stops above a predetermined capacity.

Accordingly, it is an objective and purpose of the present invention to provide a method and apparatus to control the capacity slide of compressor mechanisms by manual and pneumatic means.

It is another objective of the present invention in the preferred embodiment to provide a manually controlled capacity slide control attachment to existing compressors.

It is also an objective of the present invention in the preferred embodiment to require no electrical power relative to the apparatus or method for controlling the capacity slide mechanism.

In the preferred embodiment it is also an objective of the invention, to provide a means to determine the relative position of the internal slide mechanism as it relates to a percentage of compressor capacity.

It is yet another objective of the present invention to control the capacity slide mechanism solely by a pneumatic method and apparatus.

It is a primary advantage of the present invention to position and hold the capacity slide mechanism at any increment between zero and full capacity.

Another advantage of the present invention is the provision of automatic return to a reduced capacity state.

Yet another advantage of the present invention, in the preferred embodiment, is the provision of a control method and apparatus that requires minimal manual operating force to adjust the capacity slide mechanism position.

Still another advantage of the present invention in the preferred embodiment is the provision of controlling the entire movement of the capacity slide mechanism from limit to limit with less than one revolution of the apparatus.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate the general capacity slide mechanism, mechanical adjustment mechanism, and embodiment of the present invention, and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

Best Modes for Carrying Out the Invention

Figure 1A:
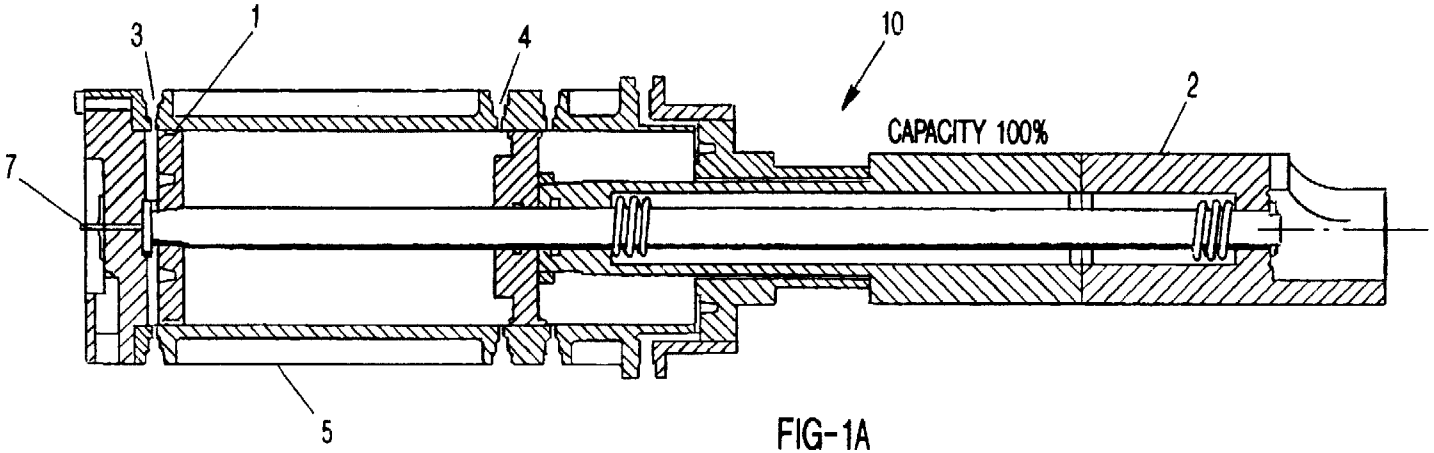
FIG-1A PRIOR ART
FIG. 1A is a cross-sectional view of a prior art electronically controlled capacity slide mechanism indication 100% capacity.
Figure 1B:
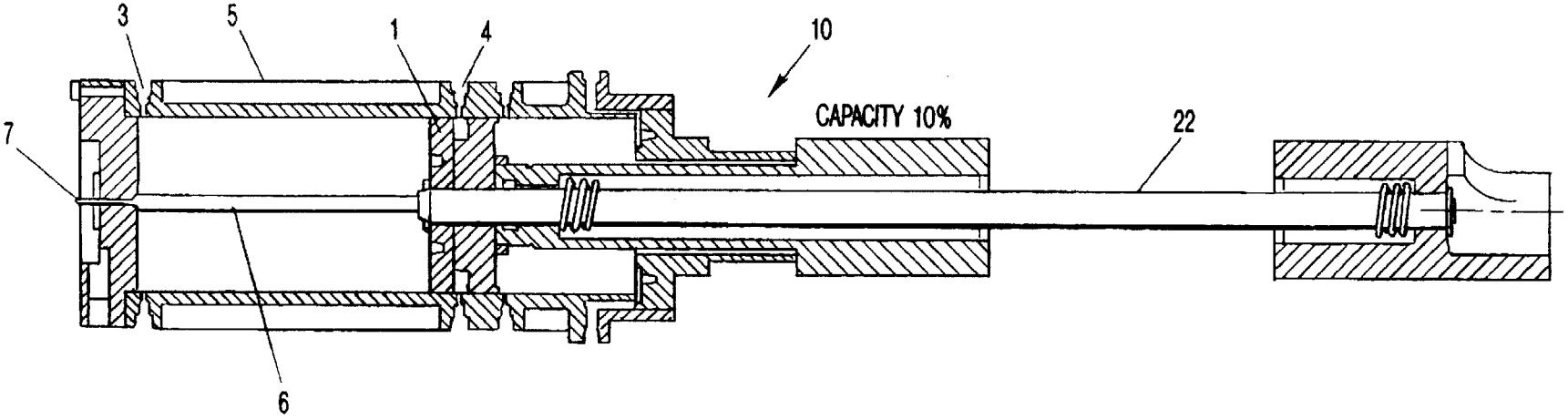
FIG-1B PRIOR ART
FIG. 1B is a cross-sectional view of a prior art electronically controlled capacity slide mechanism indicating 10% capacity.

Reference is now made to FIGS. 1(*a*) and 1(*b*), which represent prior art electronically controlled capacity slide mechanism 10 actuation at 100% and 10% capacity, respectively. Enclosed within cylinder 5 is a piston 1 attached to slide rod 22 and slide 2. The position of piston 1 and slide 2 is determined by appropriate pneumatic pressure at ports 3 and 4. Linear movement of piston 1 by pneumatic pressure effects rotary motion of threaded rotary rod 6, in turn rotating indicator rod 7. Indicator rod 7 rotates a rotary potentiometer (not shown) sending a resistance feedback signal to a microprocessor (not shown). The microprocessor signals a directional solenoid to apply or relieve pressure through ports 3 and 4 to piston 1, thereby repositioning slide 2 and the rotary potentiometer.

Figure 2:
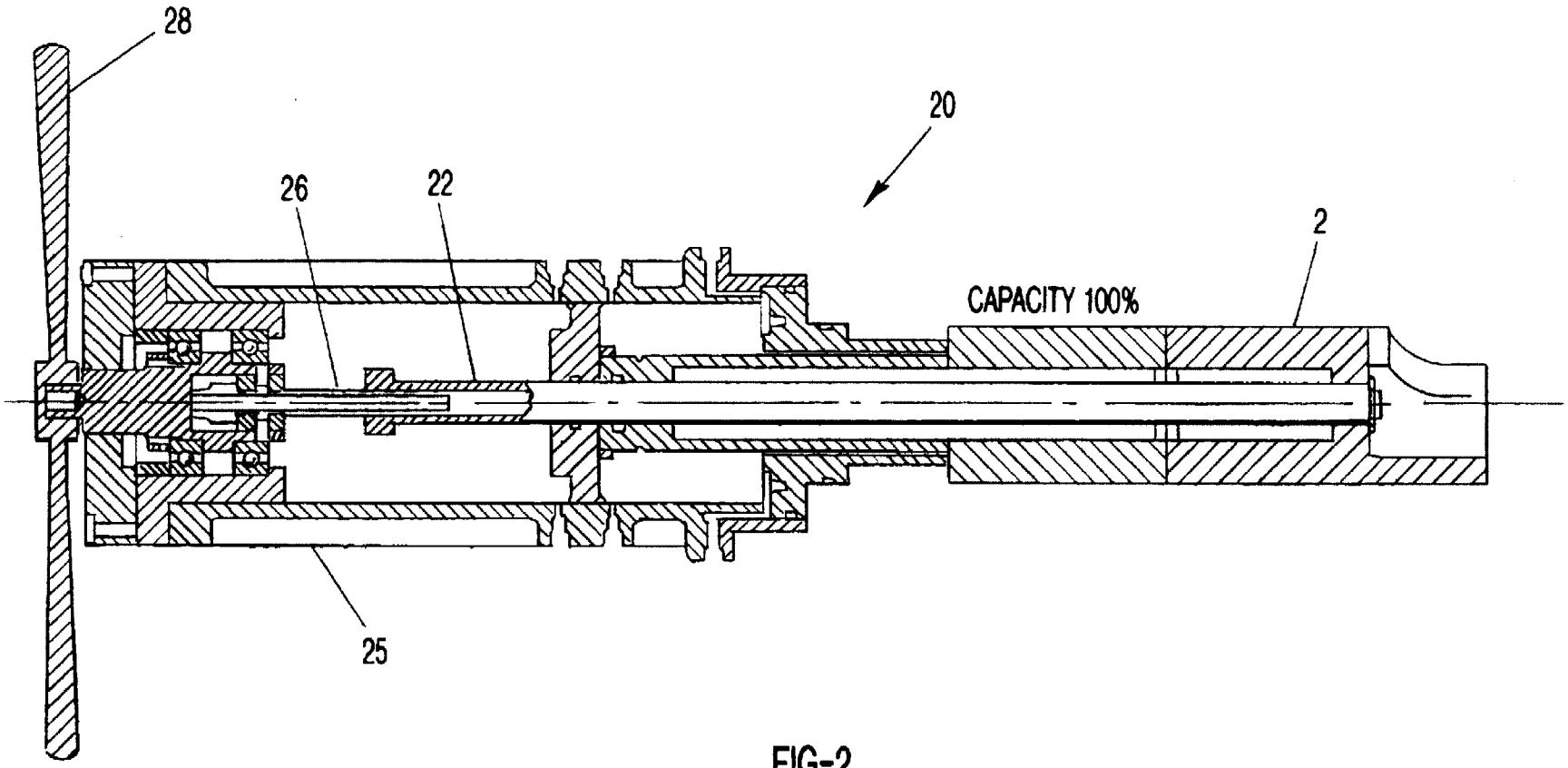
FIG-2 PRIOR ART
FIG. 2 is a cross-sectional view of a prior art mechanically controlled capacity slide mechanism.

FIG. 2 illustrates a prior art mechanically operated capacity slide mechanism. Handwheel 28 is rotated, thereby rotating externally threaded rod 26. Rod 26 rotatably engages internally threaded hollow slide rod 22, thereby effecting linear motion of rod 22 and slide 2. Position of capacity slide 2 can be approximated by counting the number of revolutions of 28 from a beginning start point at full limit of travel.

Figure 3:
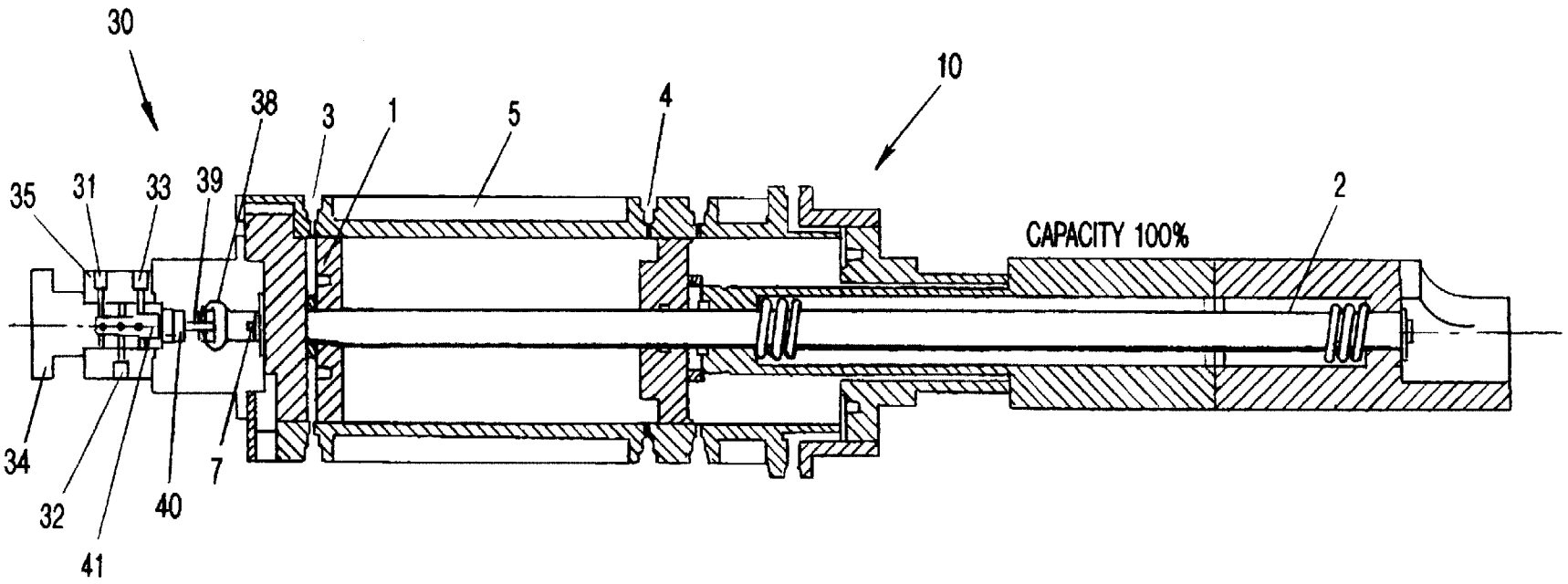
FIG. 3 is a perspective view of the present invention attached to a capacity slide mechanism.
Figure 6:
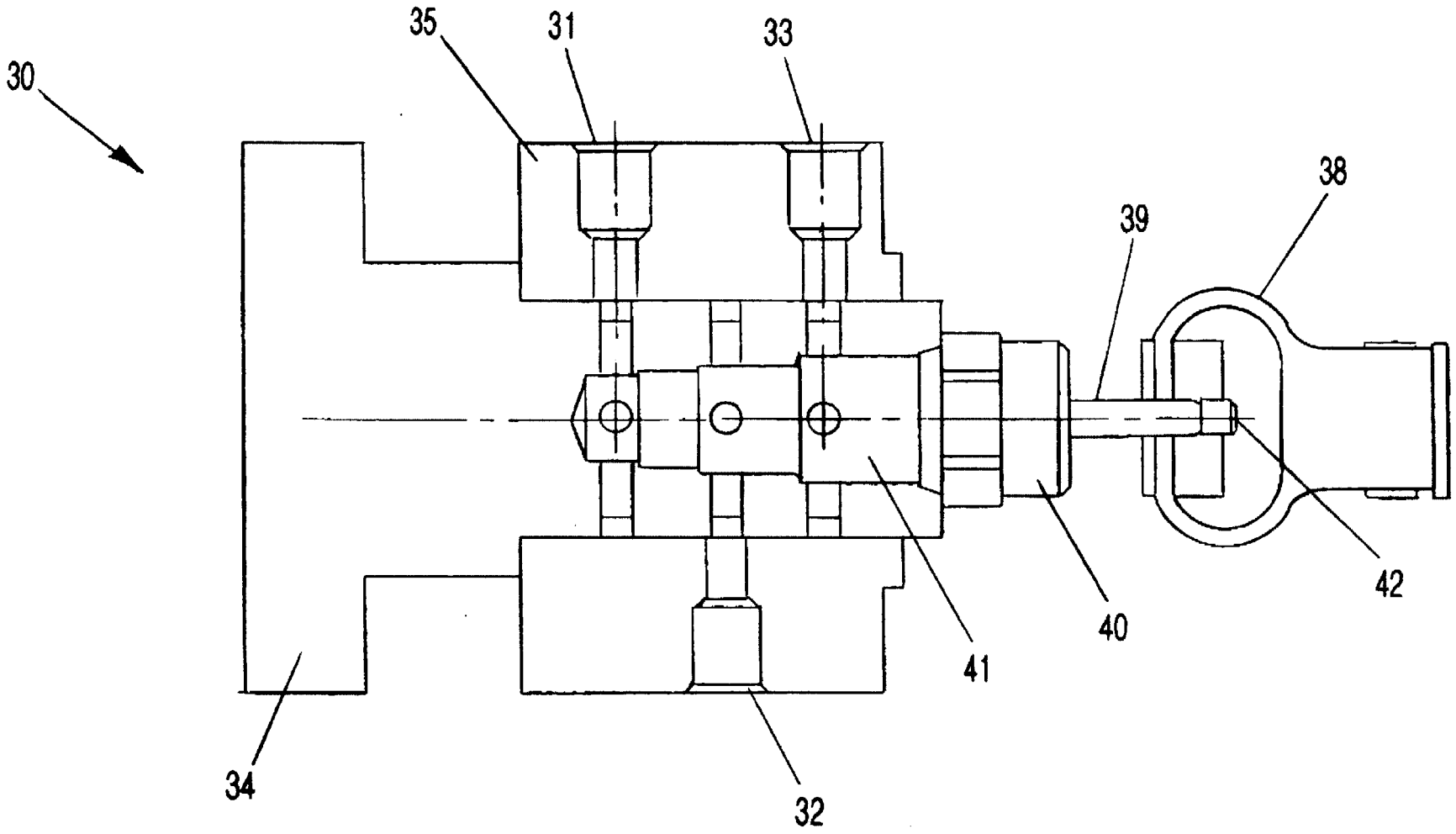
FIG. 6 shows a detailed cross-section of the apparatus of the invention.

FIG. 3 shows the present invention combined with the capacity slide mechanism of FIGS. 1(*a*) and 1(*b*). As shown in FIG. 6, controller 30 comprises manually rotatable valve body 34 which rotates freely 360° within stationary valve housing 35. Valve housing 35 further comprises ports 31, 32 and 33. Rotary valve 40 comprises ported body 41 and an internal passageway 42, which is rotatable with stem 39. Stem 39 is coupled to rotatable indicator rod 7 by resilient or flexible coupling 38. Rotary valve 40 is mounted solidly within valve body 34, and 34 and 41 thereafter rotate as one.

Figure 5:
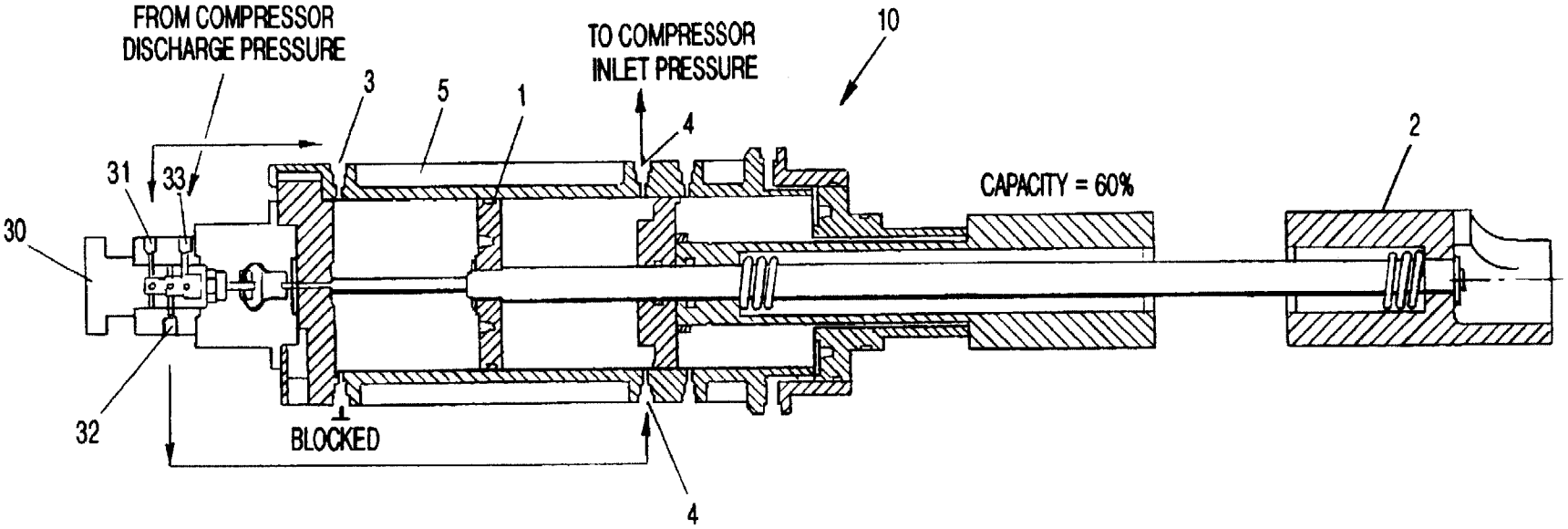
FIG. 5 shows part to part connection of the apparatus of the invention to compressor capacity slide mechanism with external porting connections.

Manual rotation of valve body 34 repositions valve body 41 and initializes communication between ports 31, 32 and 33 via internal passageway 42. As shown in FIG. 5, pressure is directed to port 3 or vented to port 4, depending upon a desired increase or reduction in compressor capacity. The resulting linear movement of piston 1 effects rotation of rod 6, thereby also rotative indicator rod 7. Rotation of indicator rod 7 rotates stem 39 through resilient coupling 38. Rotation of stem 39 rotates from either position as shown in FIGS. 7(*a*) or 7(*c*), positioning internal passageway 42 in an intermediate, blocking position, as shown in FIG. 7(*b*).

Figure 4A:
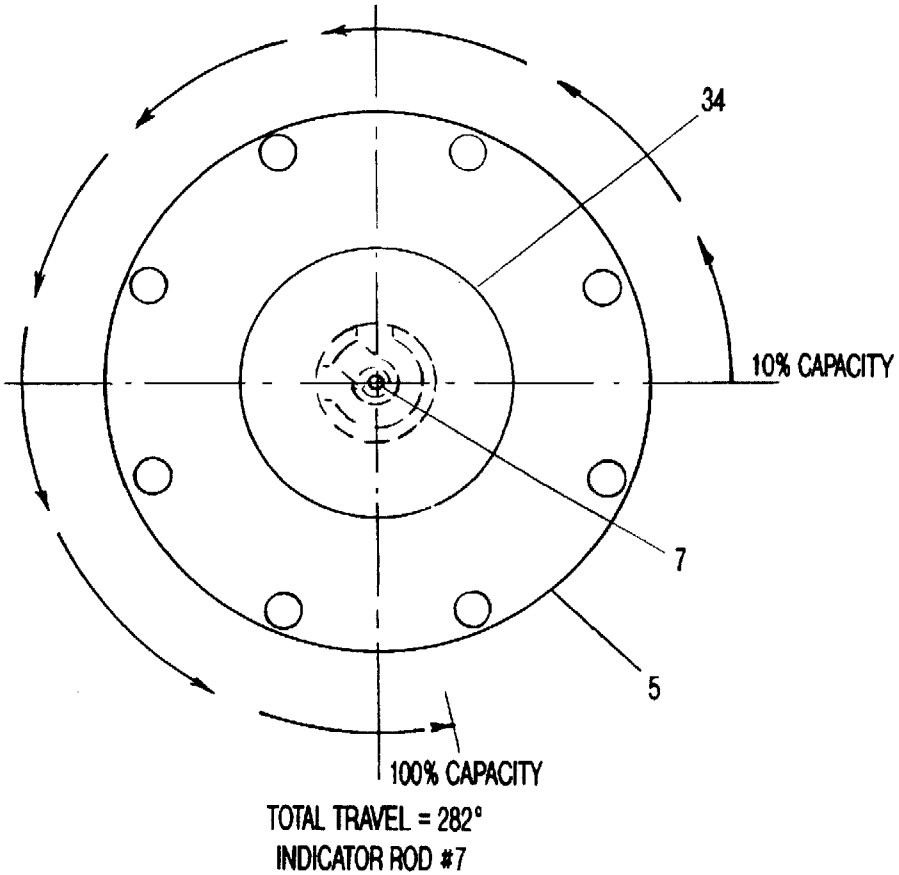
FIG. 4 shows an end view of indicator rod rotation from limit to limit.
Figure 4B:
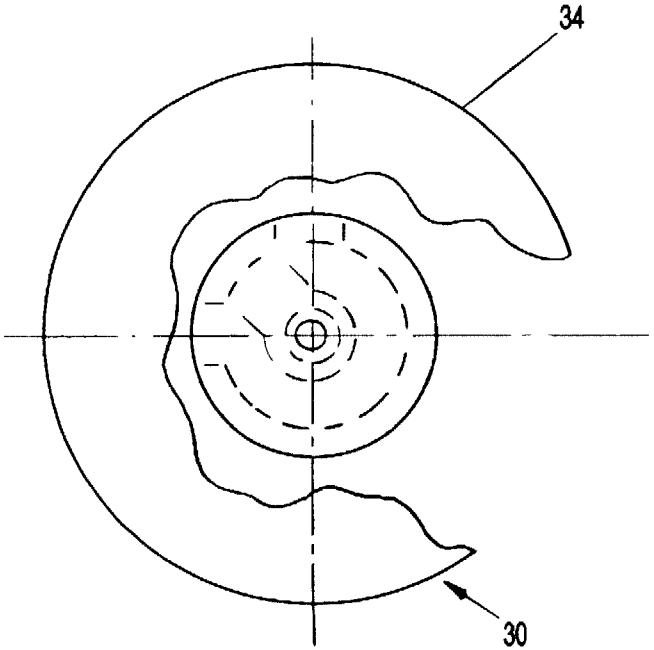
Figure 7C:
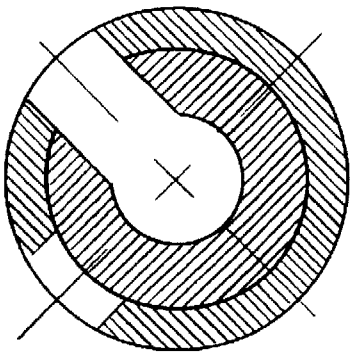
FIG. 7C shows a cross-section of the rotary valve at full limit opposite position.
Figure 7B:
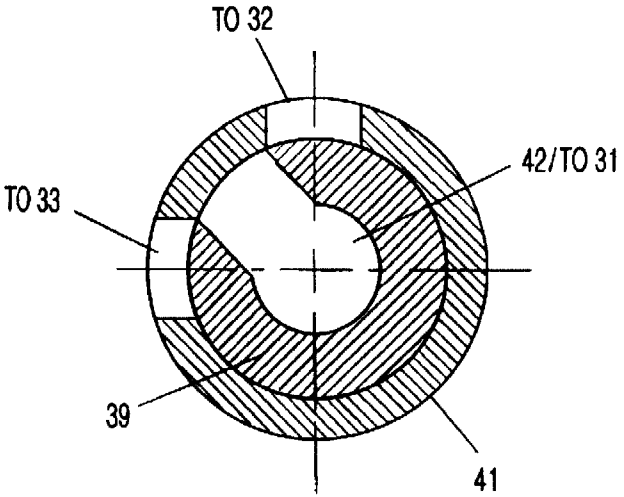
FIG. 7B shows a cross-section of the rotary valve in a neutral blocking position.
Figure 7A:
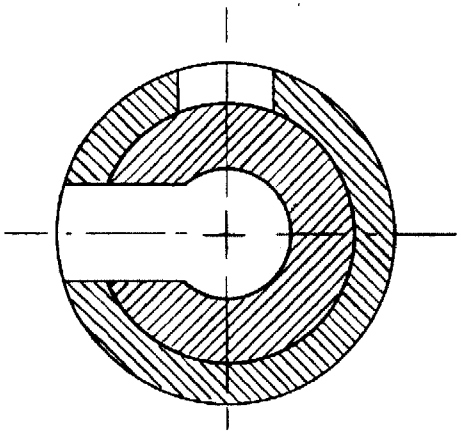
FIG. 7A shows a cross-section of the rotary valve at full limit one position.

As depicted in FIGS. 4, 5 and 7, rotation of valve body 34/41 initially determines communication between ports 31, 32, 33, 3 and 4, thereby dictating whether pressure or venting is to be applied to piston 1 within cylinder 5. During predetermined linear movement of piston 1, the resulting rotation of rod 6, indicator rod 7, coupling 38, stem 39 automatically places internal passageway 42 in an intermediate, blocking position. Pneumatic flow is terminated and piston 1 and slide 2 are thus maintained in a predetermined control position.

Manual valve body 34 is marked with a scale, to approximate the position of internal capacity slide as it relates to the percentage of the compressor's capacity.

Manual valve body 34 by design of the preferred embodiment, is free to rotate 360° within stationary valve housing 35, while rotary valve 40 has a limited rotation of 45° (referencing the rotation of stem 39 within body 41) from neutral blocking position FIG. 7(*b*) in either direction to a solid stop at position limits 7(*a*) and 7(*c*). The compressor capacity slide mechanism is mechanically positioned by spring to 10%, FIG. 1(*b*), when the compressor is at rest. At compressor stop from a running position, item 6 rotates item 7 to a 10% minimum capacity position. Item 7 rotates coupling 38 and stem 39 to a solid stop within valve body 41 and proceeds to then rotate items 40 rotary valve and 34 rotatable valve body to a position towards minimum capacity at 10% minus 45° of rotation. This position represents an internal capacity position of approximately 25%. If the compressor was operating at any capacity above 25%, as determined by a rotated position of 34 above 45° from start, it will be repositioned at compressor stop as described.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, and of the corresponding application(s), are hereby incorporated by reference.

What is claimed is:

1. A method of controlling a rotary screw compressor comprising the steps of:

(a) rotating a valve body within a stationary housing;

(b) rotating a rotary valve with the valve body; and (c) returning the valve body to a limit of between 10% and approximately 25% compressor capacity when the compressor stops above a predetermined capacity;

wherein selective rotation of the valve body and the rotary valve pneumatically controls capacity of the rotary screw compressor.

2. The method of claim 1 further comprising the step of providing the stationary housing with a plurality of ports.

3. The method of claim 1 further comprising the step of rotating the valve body through an encompassing control arc of 282°.

4. The method of claim 3 wherein the step of rotating the valve body comprises the step of effecting control of the rotary screw compressor between limits of 10% capacity to 100% capacity of the compressor.

5. The method of claim 3 further comprising the step of automatically terminating rotation of the rotary valve at a neutral position.

6. The method of claim 1 additionally comprising the step of providing to the valve body indicia indicating compressor capacity.

7. A method of controlling a rotary screw compressor comprising the steps of:

(a) rotating a valve body within a stationary housing;

(b) rotating a rotary valve with the valve body;

(c) rotating the valve body through an encompassing control arc of 282°; and (d) automatically terminating rotation of the rotary valve at a neutral position;

wherein selective rotation of the valve body and the rotary valve pneumatically controls capacity of the rotary screw compressor.

8. Apparatus for controlling a rotary screw compressor comprising:

a stationary housing;

a valve body rotatable within said stationary housing; and a rotary valve rotatable with said valve body;

wherein selective rotation of said valve body and said rotary valve controls capacity of a rotary screw compressor; and wherein said valve body returns to a limit of between 10% and approximately 25% compressor capacity when said compressor stops when operating above a predetermined capacity.

9. The apparatus of claim 8 wherein said stationary housing comprises a plurality of ports.

10. The apparatus of claim 8 wherein said valve body is rotatable through an encompassing control arc comprising 282°.

11. The apparatus of claim 10 wherein rotation of said valve body effects control of said rotary screw compressor between limits of 10% capacity to 100% capacity of said compressor.

12. The apparatus of claim 10 wherein rotation of said rotary valve is automatically terminated in a neutral position.

13. The apparatus of claim 8 wherein selective manual rotation of said valve body and said rotary valve pneumatically controls capacity of a rotary screw compressor.

14. The apparatus of claim 8 wherein said valve body comprises indicia indicating compressor capacity.

15. Apparatus for controlling a rotary screw compressor comprising:

a stationary housing;

a valve body rotatable within said stationary housing; and a rotary valve rotatable with said valve body;

wherein selective rotation of said valve body and said rotary valve controls capacity of a rotary screw compressor;

wherein said valve body is rotatable through an encompassing control arc comprising 282°; and wherein rotation of said rotary valve is automatically terminated in a neutral position.

* * * * *